US010457887B2

(12) United States Patent
van Houten

(10) Patent No.: US 10,457,887 B2
(45) Date of Patent: Oct. 29, 2019

(54) TRUNK PISTON ENGINE OIL COMPOSITION

(71) Applicant: Chevron Oronite Technology B.V., San Ramon, CA (US)

(72) Inventor: Wilhelmus Petrus Antonie van Houten, Prinsenbeek (NL)

(73) Assignee: CHEVRON ORONITE TECHNOLOGY B.V., Rotterdam (NL)

( * ) Notice: Subject to any disclaimer, the term of this patent is extended or adjusted under 35 U.S.C. 154(b) by 607 days.

(21) Appl. No.: 15/157,454

(22) Filed: May 18, 2016

(65) Prior Publication Data

US 2016/0340604 A1 Nov. 24, 2016

Related U.S. Application Data

(60) Provisional application No. 62/163,594, filed on May 19, 2015.

(51) Int. Cl.

| | |
|---|---|
| ***C10M 169/04*** | (2006.01) |
| ***C10M 101/02*** | (2006.01) |
| ***C10M 129/54*** | (2006.01) |
| ***C10M 133/58*** | (2006.01) |
| *C10N 30/02* | (2006.01) |
| *C10N 30/08* | (2006.01) |
| *C10N 30/10* | (2006.01) |
| *C10N 40/25* | (2006.01) |

(52) U.S. Cl.

CPC ..... *C10M 169/04* (2013.01); *C10M 101/02* (2013.01); *C10M 129/54* (2013.01); *C10M 133/58* (2013.01); *C10M 169/045* (2013.01); *C10M 2203/1006* (2013.01); *C10M 2203/1025* (2013.01); *C10M 2203/1045* (2013.01); *C10M 2207/262* (2013.01); *C10M 2215/28* (2013.01); *C10M 2215/30* (2013.01); *C10M 2223/045* (2013.01); *C10N 2030/02* (2013.01); *C10N 2030/08* (2013.01); *C10N 2030/10* (2013.01); *C10N 2040/25* (2013.01); *C10N 2210/02* (2013.01); *C10N 2220/021* (2013.01); *C10N 2230/02* (2013.01); *C10N 2230/04* (2013.01); *C10N 2230/08* (2013.01); *C10N 2230/10* (2013.01); *C10N 2230/43* (2013.01); *C10N 2230/52* (2013.01); *C10N 2240/10* (2013.01); *C10N 2240/102* (2013.01); *C10N 2260/00* (2013.01)

(58) Field of Classification Search

CPC ..... C10M 169/04; C10M 169/045; C10M 101/02; C10M 129/54; C10M 133/58; C10M 2203/1006; C10M 2203/1025; C10M 2203/1045; C10M 2207/262; C10M 2215/28; C10M 2215/30; C10M 2223/045; C10N 2220/021; C10N 2230/02; C10N 2230/04; C10N 2230/08; C10N 2230/10; C10N 2230/52; C10N 2230/224; C10N 2230/102; C10N 2260/00; C10N 2030/02; C10N 2030/08; C10N 2030/10; C10N 2040/25; C10N 2240/10; C10N 2210/02; C10N 2230/43

See application file for complete search history.

(56) References Cited

U.S. PATENT DOCUMENTS

| | | | |
|---|---|---|---|
| 3,172,892 | A | 3/1965 | Le Suer et al. |
| 3,219,666 | A | 11/1965 | Norman et al. |
| 3,272,746 | A | 9/1966 | Le Suer et al. |
| 4,234,435 | A | 11/1980 | Meinhardt et al. |
| 5,334,321 | A | 8/1994 | Harrison et al. |
| 5,356,552 | A | 10/1994 | Harrison et al. |
| 6,165,235 | A | 12/2000 | Kolp et al. |
| 6,372,696 | B1 | 8/2002 | Tipton |
| 6,440,905 | B1 | 8/2002 | Epps et al. |
| 2007/0027043 | A1 | 2/2007 | LeCoent |
| 2011/0077179 | A1 | 3/2011 | Van Houten et al. |
| 2013/0157910 | A1 | 6/2013 | Li et al. |

FOREIGN PATENT DOCUMENTS

| | | |
|---|---|---|
| CA | 2663879 | * 11/2009 |
| EP | 2071009 | 6/2009 |
| EP | 2128231 | 12/2009 |
| EP | 2604676 | 6/2013 |

OTHER PUBLICATIONS

Relationship between Chemical Structure and Effectiveness of some Metallic Dialkyl- and Diaryl-dithiophosphates in Different Lubricated Mechanisms, appearing in Lubrication Science 4-2 Jan. 1992, see for example pp. 97-100.

Leslie R. Rudnick, "Lubricant Additives: Chemistry and Applications," New York, Marcel Dekker, Chapter 1, pp. 1-28 (2003).

PCT International Search Report, International Appl. No. PCT/EP2016/061116, dated Jul. 26, 2016.

* cited by examiner

*Primary Examiner* — Cephia D Toomer

(74) *Attorney, Agent, or Firm* — Thomas P. Weber; Michael Sungjoon Pio

(57) ABSTRACT

A low sulfur marine distillate fuel trunk piston diesel engine lubricating oil composition comprising (a) a major amount of a Group I base oil or a Group II base oil or mixtures thereof; (b) at least one or more detergents comprising at least one overbased salt of an alkyl-substituted hydroxybenzoic acid; and (c) a succinimide dispersant derived from polyalkylene having a number average molecular weight (Mn) of 1400-3000; wherein the succinimide dispersant is present at greater than 1.20 wt. % on an actives basis; and the TBN of the composition is less than 30 mg KOH/g.

20 Claims, No Drawings

TRUNK PISTON ENGINE OIL COMPOSITION

FIELD OF THE INVENTION

The present invention generally relates to a trunk piston engine oil composition designed for use with low sulfur distillate fuel where the lubricating oil has a low base number but is capable of providing oxidative stability, viscosity increase control, and improved detergency performance.

BACKGROUND OF THE INVENTION

Trunk piston engines are generally medium speed (300-1000 rpm), 4-stroke engines, in which a single lubricating oil is employed for lubrication of all areas of the engine, as opposed to the crosshead engines in which the crosshead allows for use of separate lubricants in the cylinder and in the crankcase. A trunk piston engine oil (TPEO) therefore has unique requirements for fuel compatibility, oxidative stability, viscosity increase control, and detergency.

Traditionally fuel oils used for the operation of trunk piston engines have ranged from heavy marine residual fuel to low sulfur distillate fuel. Recently, driven by health and environmental concerns, there has been increasing probability of future regulations mandating the use of low sulfur fuel for the operation of trunk piston engines. The use of low sulfur residual fuel requires that it is feasible for refineries to lower the sulfur level in residual fuel at a reasonable cost and effort. It is unknown whether there will be sufficient low-sulfur residual fuel oil available in the future, or whether low sulfur distillate fuel and gas oils will be used to a wider extent. It is therefore desirable to provide a trunk piston engine oil composition designed for use with low sulfur distillate fuel where the lubricating oil has a low base number but is capable of providing oxidative stability, viscosity increase control, and improved detergency performance.

Additives, especially metal-containing alkaline detergent additives, have been used for many years in TPEOs to neutralize acid combustion gases, maintain engine cleanliness, ensure compatibility of the lubricant with residual fuel oil, and control viscosity increase. However, it remains unclear if TPEOs formulated with additive technology developed for use with residual fuel oils will in fact be optimum for the low sulfur distillate marine fuels of the future due to differences in the characteristics of the fuels and differences in the environment of trunk piston engines due to the varying sources of fuels. For marine residual fuel operation, key performance parameters of trunk piston engine oils are almost exclusively driven by asphaltenes contamination. For distillate fuel operation, however, where the fuel contains no significant asphaltenes, key performance parameters are driven by combustion by-products from the distillate fuel. Therefore, the requirements for engines operated using low sulfur distillate fuels versus marine residual fuels are very different. As a result, this does not allow for performance read-across of a formulation from marine residual fuels operation to distillate fuel operation or vice versa.

The addition of dispersant, particularly in high concentrations, has traditionally been found to be detrimental to key performance parameters of Group I and/or Group II based trunk piston engine oils designed for use with marine residual fuel. It has been now been surprisingly discovered that Group I and/or Group II based marine trunk piston engine lubricating oil compositions designed for the lubrication of trunk piston engines operating on low sulfur distillate fuel, containing a detergent comprising at least one salt of an alkyl-substituted hydroxybenzoic acid wherein at least 90 mole % of the alkyl groups are $C_{20}$ or greater, in combination with a succinimide dispersant derived from polyalkylene having a number average molecular weight ($M_n$) of 1400 to 3000, wherein the dispersant is present at greater than 1.2 wt. % on an actives basis and the lubricating oil composition has a Total Base Number of less than 30, leads to optimum performance in the areas of oxidative stability, viscosity increase control, and high temperature detergency.

SUMMARY OF THE INVENTION

In accordance with one embodiment of the present invention, there is provided a low sulfur marine distillate fuel trunk piston diesel engine lubricating oil composition comprising:

(a) a major amount of a Group I base oil or a Group II base oil or mixtures thereof;

(b) at least one or more detergents comprising at least one overbased salt of an alkyl-substituted hydroxybenzoic acid wherein at least 90 mole % of the alkyl groups are $C_{20}$ or greater; and (c) a succinimide dispersant derived from polyalkylene having a number average molecular weight ($M_n$) of 1400-3000;

wherein the succinimide dispersant is present at greater than 1.20 wt. % on an actives basis;

and the TBN of the composition is less than 30 mg KOH/g.

In accordance with another embodiment of the present invention, there is provided a low sulfur marine distillate fuel trunk piston diesel engine lubricating oil composition comprising:

(a) a major amount of a Group I base oil or a Group II base oil or mixtures thereof;

(b) a detergent composition comprising:

(i) a medium overbased detergent comprising an overbased salt of a linear alkyl-substituted hydroxybenzoic acid, wherein at least 90 mole % of the alkyl groups are $C_{20}$ or greater, and wherein the TBN of the medium overbased detergent on an actives basis is from about 100 to 300 mg KOH/g; and (ii) a high overbased detergent comprising an overbased salt of a linear alkyl-substituted hydroxybenzoic acid, wherein at least 90 mole % of the alkyl groups are $C_{20}$ or greater, and wherein the TBN of the high overbased detergent on an actives basis is greater than about 300 mg KOH/g; and (c) an ethylene carbonate post-treated bis-succinimide dispersant derived from polyisobutylene having a number average molecular weight (Mn) of 1400-3000;

wherein the succinimide dispersant is present at greater than 1.2 wt. % on an actives basis; and the TBN of the composition is less than 30 mg KOH/g.

In accordance with another embodiment of the present invention, there is provided a method for operating a trunk piston engine, the method comprising:

(a) fueling the engine with a low sulfur marine distillate fuel, and (b) lubricating the engine with a lubricating oil composition comprising:

(1) a major amount of a Group I base oil or a Group II base oil or mixtures thereof;

(2) at least one or more detergents comprising at least one overbased salt of an alkyl-substituted hydroxybenzoic acid wherein at least 90 mole % of the alkyl groups are $C_{20}$ or greater; and (3) a succinimide dispersant derived from polyalkylene having a number average molecular weight (Mn) of 1400-3000;

wherein the succinimide dispersant is present at greater than 1.2 wt. % on an actives basis; and the TBN of the composition is less than 30 mg KOH/g.

It has now been surprisingly discovered that marine trunk piston engine lubricating oil compositions designed for the lubrication of trunk piston engines operating on low sulfur distillate fuel, comprising the above composition leads to optimum performance in the areas of oxidative stability, viscosity increase control, and high temperature detergency.

DETAILED DESCRIPTION OF THE INVENTION

The following terms will be used throughout the specification and will have the following meanings unless otherwise indicated. Any term, abbreviation or shorthand not defined is understood to have the ordinary meaning used by a skilled artisan contemporaneous with the submission of this application.

"A major amount" refers to a concentration of at least about 50 wt. %. In some embodiments, "a major amount" refers to a concentration of at least about 60 wt. %, at least about 70 wt. %, at least about 80 wt. %, or at least about 90 wt. %.

A "low sulfur distillate fuel" refers to a fuel having about 1.5 wt. % or less of sulfur, such as fuels having about 0.1 wt. % or less, about 0.3 wt. % or less, about 0.01 wt. % or less, about 0.002 wt. % or less, or even about 0.001 wt. % or less of sulfur, relative to the total weight of the fuel wherein the fuel is a distillation cut of a distillation process.

A "residual fuel" refers to a material combustible in large marine engines which has a carbon residue, as defined in International Organization for Standardization (ISO) 10370) of at least 2.5 wt. % (e.g., at least 5 wt. %, or at least 8 wt. %) (relative to the total weight of the fuel), a viscosity at 50° C. of greater than 14.0 cSt, such as the marine residual fuels defined in the International Organization for Standardization specification ISO 8217:2005, "Petroleum products—Fuels (class F)—Specifications of marine fuels," the contents of which are incorporated herein in their entirety. Residual Fuel are primarily the non-boiling fractions of crude oil distillation. Depending on the pressures and temperatures in refinery distillation processes, and the types of crude oils, slightly more or less gas oil that could be boiled off is left in the non-boiling fraction, creating different grades of Residual Fuels.

A "marine residual fuel" refers to a fuel meeting the specification of a marine residual fuel as set forth in the ISO 8217:2010 international standard. A "low sulfur marine fuel" refers to a fuel meeting the specification of a marine residual fuel as set forth in the ISO 8217:2010 specification that, in addition, has about 1.5 wt. % or less, or even about 0.5% wt. % or less, of sulfur, relative to the total weight of the fuel, wherein the fuel is the residual product of a distillation process.

Distillate fuel is composed of petroleum fractions of crude oil that are separated in a refinery by a boiling or "distillation" process. A "marine distillate fuel" refers to a fuel meeting the specification of a marine distillate fuel as set forth in the ISO 8217:2010 international standard. A "low sulfur marine distillate fuel" refers to a fuel meeting the specification of a marine distillate fuel set forth in the ISO 8217:2010 international standard that, in addition, has about 0.1 wt. % or less, 0.05 wt. % or less, or even about 0.005 wt. % or less, of sulfur, relative to the total weight of the fuel, wherein the fuel is a distillation cut of a distillation process.

A "high sulfur fuel" refers to a fuel having greater than 1.5 wt. % of sulfur, relative to the total weight of the fuel.

The term "bright stock", as used by persons skilled in the art, refers to base oils that are direct products of de-asphalted petroleum vacuum residuum or derived from de-asphalted petroleum vacuum residuum after further processing such as solvent extraction and/or dewaxing. For the purposes of this invention, it also refers to de-asphalted distillate cuts of a vacuum residuum process. Bright stocks generally have a kinematic viscosity at 100.degree. C. of from 28 to 36 mm·sup·2/s. One example of such a bright stock is ESSO™. Core 2500 Base Oil.

The term "Group II metal" or "alkaline earth metal" means calcium, barium, magnesium, and strontium.

The term "calcium base" refers to a calcium hydroxide, calcium oxide, calcium alkoxide and the like and mixtures thereof.

The term "lime" refers to calcium hydroxide also known as slaked lime or hydrated lime.

The term "alkylphenol" refers to a phenol group having one or more alkyl substituents at least one of which has a sufficient number of carbon atoms to impart oil solubility to the resulting phenate additive.

The term "Total Base Number" or "TBN" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids.

The term "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both.

The term "on an actives basis" indicates that only the active component(s) of a particular additive are considered when determining the concentration or amount of that particular additive within the overall marine trunk piston engine lubricating oil composition. Diluent oil in the additive is excluded.

In the following description, all numbers disclosed herein are approximate values, regardless whether the word "about" or "approximate" is used in connection therewith. They may vary by 1 percent, 2 percent, 5 percent, or, sometimes, 10 to 20 percent.

The lubricating oil compositions, trunk piston engine lubricating oil compositions, and trunk piston engine oils (TPEO) described herein (collectively "lubricating oil compositions") can be used for lubricating any trunk piston engine, marine trunk piston engine, or compression-ignited (diesel) marine engine, such as a 4-stroke trunk piston engine or a 4-stroke diesel marine engine.

With respect to the one or more detergents contained in the trunk piston engine lubricating oil composition, representative examples of suitable detergents include, but are not limited to, sulfurized or unsulfurized alkyl or alkenyl phenates, alkyl or alkenyl aromatic sulfonates, borated sulfonates, sulfurized or unsulfurized metal salts of multi hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and the like and mixtures thereof. Other non-limiting examples of suitable metal detergents include, but are not limited to, metal sulfonates, phenates, salicylates, phosphonates, thiophosphonates and combinations thereof. The metal can be any metal suitable for making sulfonate, phenate, salicylate or phosphonate detergents such as alkali metals, alkaline earth metals and transition metals and the like. Examples of such metals include Ca, Mg, Ba, K, Na, Li and the like. In one embodiment, the metal suitable for making the detergents is an alkaline earth metal such as Ca or Mg. In another embodiment, the metal suitable for making the detergents is Ca.

The detergent can be any overbased or neutral detergent. In one embodiment, the detergent is a salt of an alkyl-substituted hydroxybenzoic acid, such as an overbased alkyl-hydroxybenzoate detergent, e.g., an overbased metal salt of an alkyl-substituted hydroxybenzoic acid detergent, and the like and mixtures thereof. Generally, an overbased detergent is any detergent in which the TBN of the additive has been increased by a process such as the addition of a base source (e.g., lime) and an acidic overbasing compound (e.g., carbon dioxide). Overbased metal detergents are generally produced by carbonating a mixture of hydrocarbons, detergent acid, for example: sulfonic acid, alkylphenol, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or Ca $(OH)_2$, to form the sulfonate.

In one embodiment, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

In one embodiment, the alkali or alkaline earth metal salts of an alkyl-substituted hydroxybenzoic acid is an overbased alkali or alkaline earth metal salt of an alkyl-substituted hydroxybenzoic acid having a TBN of greater than 150 mg KOH/g on an actives basis. In one embodiment, the TBN of the overbased alkali or alkaline earth metal salt of an alkyl-substituted hydroxybenzoic acid is from about 100 to about 600 mg KOH/g on an actives basis. In one embodiment, the TBN of the overbased alkali or alkaline earth metal salts of an alkyl-substituted hydroxybenzoic acid is from about 150 to about 550 mg KOH/g on an actives basis.

In one embodiment, the overbased metal salt of an alkyl-substituted hydroxybenzoic acid is an overbased alkali metal salt of an alkyl-substituted hydroxybenzoic acid, wherein the alkali metal is lithium, sodium or potassium.

In one embodiment, the overbased metal salt of an alkyl-substituted hydroxybenzoic acid is an overbased alkaline earth metal salt of an alkyl-substituted hydroxybenzoic acid, wherein the alkaline earth metal can be selected from the group consisting of calcium, barium, magnesium and strontium. Calcium and magnesium are preferred. More preferred is calcium.

In another embodiment, the one or more detergents is an overbased salt (such as an overbased alkaline earth metal salt) of a mixture of alkyl-substituted hydroxybenzoic acid and alkyl-substituted phenol. In another embodiment, the one or more detergents is an overbased salt of an alkyl-substituted hydroxybenzoic acid and/or an overbased salt of an alkyl-substituted phenol, in combination with a non-overbased salt of one or more of: an alkyl-substituted hydroxybenzoic acid and an alkyl-substituted phenol. In another embodiment, the one or more detergents is an overbased salt of an alkyl-substituted hydroxybenzoic acid and no other overbased salts (other than the salt of the detergent). The detergent, in this regard, can contain any suitable concentration of anion (e.g., organic anion) associated with the alkylhydroxybenzoate (or salt of the alkyl-substituted hydroxybenzoic acid).

The alkyl substituted moiety of the alkali or alkaline earth metal salt of an alkyl-substituted hydroxyaromatic carboxylic acid can be derived from an alpha olefin having from about 10 to about 80 carbon atoms. The olefins employed may be linear or branched. The olefin may be a mixture of linear olefins, a mixture of isomerized linear olefins, a mixture of branched olefins, a mixture of partially branched linear or a mixture of any of the foregoing. In one embodiment, the mixture of linear olefins that may be used is a mixture of normal alpha olefins selected from olefins having from about 12 to about 30 carbon atoms per molecule. In one embodiment, the alkyl substituted moiety of the alkali or alkaline earth metal salt of an alkyl-substituted hydroxyaromatic carboxylic acid is the residue of linear normal alpha-olefins containing at least 75 mole % $C_{20}$ or higher linear normal alpha-olefins. In one embodiment, the normal alpha olefins are isomerized using at least one of a solid or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In another embodiment, at least about 75 mole % (e.g., at least about 80 mole %, at least about 85 mole %, at least about 90 mole %, at least about 95 mole %, or at least about 99 mole %) of the alkyl groups contained within the detergent such as the alkyl groups of a salt of an alkyl-substituted hydroxybenzoic acid detergent, or of an alkyl-substituted hydroxybenzoic acid) are a $C_{20}$ or higher (such as $C_{20}$ to $C_{40}$, $C_{20}$ to $C_{35}$, $C_{20}$ to $C_{30}$, $C_{20}$ to $C_{28}$, or $C_{20}$ to $C_{25}$). In another embodiment, the detergent is a salt of an alkyl-substituted hydroxybenzoic acid that is derived from an alkyl-substituted hydroxybenzoic acid in which the alkyl groups are the residue of linear normal alpha-olefins containing at least 75 mole % $C_{20}$ or higher linear normal alpha-olefins. If desired, the salt (e.g., an overbased salt) of an alkyl-substituted hydroxybenzoic acid is an alkaline earth salt (e.g., calcium or magnesium) of an alkyl-substituted hydroxybenzoic acid.

In one embodiment, the overbased alkali or alkaline earth metal salts of an alkyl-substituted hydroxybenzoic acid is an overbased salt, having a mixture of $C_{20}$ to $C_{28}$ alkyl groups, can be prepared from linear alpha olefin cuts, such as those marketed by Chevron Phillips Chemical Company under the names Normal Alpha Olefin $C_{26}$ to $C_{28}$ or Normal Alpha Olefin $C_{20}$ to $C_{24}$ being mixtures of these cuts having from about 20 to 28 carbon atoms.

The resulting alkali or alkaline earth metal salt of an alkyl-substituted hydroxybenzoic acid will be a mixture of ortho and para isomers. In one embodiment, the product will contain about 1 to 99 wt. % ortho isomer and 99 to 1 wt. % para isomer. In another embodiment, the product will contain about 5 to 70 wt. % ortho and 95 to 30 wt. % para isomer.

Generally, the overbased alkali or alkaline earth metal salts of an alkyl-substituted hydroxybenzoic acid is present in the lubricating oil composition in an amount ranging from about 0.01 wt. % to about 20 wt. %, based on the total weight of the lubricating oil composition. In one embodiment, the overbased alkali or alkaline earth metal salts of an alkyl-substituted hydroxybenzoic acid is present in the lubricating oil composition in an amount ranging from about 0.01 wt. % to about 15 wt. %. In one embodiment, the overbased alkali or alkaline earth metal salts of an alkyl-substituted hydroxybenzoic acid is present in the lubricating oil composition in an amount ranging from about 0.01 wt. % to about 10 wt. %. In one embodiment, the overbased alkali or alkaline earth metal salts of an alkyl-substituted hydroxybenzoic acid is present in the lubricating oil composition in an amount ranging from about 0.01 wt. % to about 6 wt. %.

In one embodiment, the detergent comprising at least one overbased alkali or alkaline earth metal salt of an alkyl-substituted hydroxybenzoic acid is a detergent composition comprising (i) a medium overbased detergent comprising an overbased alkali or alkaline earth metal salt of an alkyl-substituted hydroxybenzoic acid; and (ii) a high overbased detergent comprising an overbased alkali or alkaline earth metal salt of an alkyl-substituted hydroxybenzoic acid.

In one embodiment, the detergent comprising at least one overbased alkali or alkaline earth metal salt of an alkyl-substituted hydroxybenzoic acid is a detergent composition comprising (i) a medium overbased detergent comprising an overbased alkali or alkaline earth metal salt of an alkyl-substituted hydroxybenzoic acid; and (ii) a high overbased detergent comprising an overbased alkali or alkaline earth metal salt of an alkyl-substituted hydroxybenzoic acid, wherein at least about 90 mole % of the alkyl groups of the medium overbased alkali or alkaline earth metal salts of an alkyl-substituted hydroxybenzoic acid are $C_{20}$ or greater; and wherein at least about 90 mole % of the alkyl groups of the high overbased alkali or alkaline earth metal salts of an alkyl-substituted hydroxybenzoic acid are $C_{20}$ or greater.

In one embodiment, the detergent comprising at least one overbased alkali or alkaline earth metal salt of an alkyl-substituted hydroxybenzoic acid is a detergent composition comprising (i) a medium overbased detergent comprising an overbased alkali or alkaline earth metal salt of an alkyl-substituted hydroxybenzoic acid; and (ii) a high overbased detergent comprising an overbased alkali or alkaline earth metal salt of an alkyl-substituted hydroxybenzoic acid, wherein at least about 90 mole % of the alkyl groups of the medium overbased alkali or alkaline earth metal salts of an alkyl-substituted hydroxybenzoic acid are the residue of linear normal alpha-olefins containing $C_{20}$ to $C_{28}$ alkyl groups; and wherein at least about 90 mole % of the alkyl groups of the high overbased alkali or alkaline earth metal salts of an alkyl-substituted hydroxybenzoic acid are the residue of linear normal alpha-olefins containing $C_{20}$ to $C_{28}$ alkyl groups.

In one embodiment, the medium overbased alkali or alkaline earth metal salts of an alkyl-substituted hydroxybenzoic acid is an overbased alkali or alkaline earth metal salt having a TBN from about 100 to about 300 mg KOH/g on an actives basis. In one embodiment, the TBN of the medium overbased alkali or alkaline earth metal salts of an alkyl-substituted hydroxybenzoic acid is from 150 to 300 mg KOH/g. In another embodiment, the TBN of a medium overbased alkali or alkaline earth metal salts of an alkyl-substituted hydroxybenzoic acid is from 100 to 260 mg KOH/g. In another embodiment, the TBN of a medium overbased alkali or alkaline earth metal salts of an alkyl-substituted hydroxybenzoic acid is from 150 to 260 mg KOH/g In one embodiment, the high overbased alkali or alkaline earth metal salts of an alkyl-substituted hydroxybenzoic acid is an overbased salt having a TBN greater than 300 mg KOH/g on an actives basis. In one embodiment, the TBN of the high overbased alkali or alkaline earth metal salts of an alkyl-substituted hydroxybenzoic acid is from 325 to 700 mg KOH/g. In another embodiment, the TBN of the high overbased alkali or alkaline earth metal salts of an alkyl-substituted hydroxybenzoic acid is from 350 to 650 mg KOH/g. In another embodiment, the TBN of the high overbased alkali or alkaline earth metal salts of an alkyl-substituted hydroxybenzoic acid is from 350 to 600 mg KOH/g. In another embodiment, the TBN of a high overbased alkali or alkaline earth metal salts of an alkyl-substituted hydroxybenzoic acid is from 400 to 600 mg KOH/g.

In one embodiment, the detergent employed in the present invention is a detergent composition comprising (i) a medium overbased detergent comprising an overbased salt of an alkyl-substituted hydroxybenzoic acid, wherein at least 90 mole % of the alkyl groups are $C_{20}$ or greater, and wherein the TBN of the medium overbased detergent on an actives basis is from about 100 to 300 mg KOH/g; and (ii) a high overbased detergent comprising an overbased salt of an alkyl-substituted hydroxybenzoic acid, wherein at least 90 mole % of the alkyl groups are $C_{20}$ or greater, and wherein the TBN of the high overbased detergent on an actives basis is greater than about 300 mg KOH/g.

Generally, the medium and high overbased alkali or alkaline earth metal salts of an alkyl-substituted hydroxybenzoic acid are each present in the lubricating oil composition in an amount ranging from about 0.01 wt. % to about 10.0 wt. %, based on the total weight of the lubricating oil composition. In one embodiment, the medium overbased alkali or alkaline earth metal salts of an alkyl-substituted hydroxybenzoic acid is present at from 1.0 to 8.0 wt %. In one embodiment, the medium overbased alkali or alkaline earth metal salts of an alkyl-substituted hydroxybenzoic acid is present at from 1.0 to 6.0 wt %. In one embodiment, the medium overbased alkali or alkaline earth metal salts of an alkyl-substituted hydroxybenzoic acid is present at from 1.0 to 5.0 wt %. In one embodiment, the medium overbased alkali or alkaline earth metal salts of an alkyl-substituted hydroxybenzoic acid is present at from 2.0 to 5.0 wt %.

In one embodiment, the high overbased alkali or alkaline earth metal salts of an alkyl-substituted hydroxybenzoic acid is present at from 1.0 to 8.0 wt %. In one embodiment, the high overbased alkali or alkaline earth metal salts of an alkyl-substituted hydroxybenzoic acid is present at from 1.0 to 6.0 wt %. In one embodiment, the high overbased alkali or alkaline earth metal salts of an alkyl-substituted hydroxybenzoic acid is present is present at from 1.0 to 5.0 wt %. In one embodiment, the high overbased alkali or alkaline earth metal salts of an alkyl-substituted hydroxybenzoic acid is present at from 1.0 to 4.0 wt %.

In one embodiment, the ratio of the medium overbased alkali or alkaline earth metal salts of an alkyl-substituted hydroxybenzoic acid present to the high overbased alkali or alkaline earth metal salts of an alkyl-substituted hydroxybenzoic acid present is 0.1:1 to 10:1 based on the weight % of the medium overbased alkali or alkaline earth metal salts of an alkyl-substituted hydroxybenzoic acid to the weight % of the high overbased alkali or alkaline earth metal salts of an alkyl-substituted hydroxybenzoic acid in the lubricating oil composition. In other embodiments the ratio is 1.0:1 to 3.0:1, 0.5:1 to 5:1, 1.15:1 to 2.0:1 and 0.1:1 to 5:1.

In one embodiment, the medium overbased alkali or alkaline earth metal salts of an alkyl-substituted hydroxybenzoic acid can be prepared from alkylphenols, for example, according to the method described in Example 3 of U.S. Patent Application Publication No. 2007/0027043, the contents of which are incorporated herein by reference in their entirety.

In one embodiment, the high overbased alkali or alkaline earth metal salts of an alkyl-substituted hydroxybenzoic acid can be prepared from alkylphenols, for example, according to the method described in Example 1 of U.S. Patent Application Publication No. 2007/0027043, the contents of which are incorporated herein by reference in their entirety.

The trunk piston engine lubricating oil compositions will contain one or more ashless dispersants. Representative examples of suitable ashless dispersants include, but are not limited to amines, alcohols, amides, or ester polar moieties attached to a polymer backbone via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, esters, and salts.

Succinimide dispersants are a type of carboxylic dispersant. They are produced by reacting hydrocarbyl-substituted succinic acylating agent with organic hydroxy compounds, or with amines such as monoamines or polyamines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

In one embodiment, the reaction product of hydrocarbyl-substituted succinic acylating agent with alkylene polyamine will result in a succinimide dispersant comprising a mixture of compounds including mono-succinimides and bis-succinimides. The amount of mono alkenyl succinimide and his alkenyl succinimide produced relay depend on the charge mole ratio of alkylene polyamine to succinic groups and the particular polyamine used. Charge mole ratios of alkylene polyamine to succinic groups of about 1:1 produce a predominantly mono-succinimide dispersant. Charge mole ratios of alkylene polyamine to succinic groups of about 1:2 may produce a predominantly bis-succinimide dispersant. Examples of succinimide dispersants include those described in, for example, U.S. Pat. Nos. 3,172,892, 4,234,435 and 6,165,235, which are herein fully incorporated by reference. Succinimide dispersants which are primarily bis-succinimide contain a major amount of bis-succinimide relative to other compounds, such as mono-succinimide, that may be present in the succinimide dispersant.

Succinic-based dispersants have a wide variety of chemical structures. One class of succinic-based dispersants may be represented by formula I:

Formula I

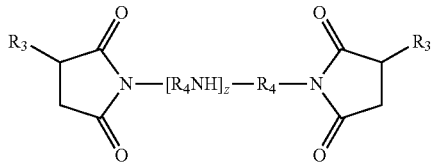

wherein each $R_3$ is independently a hydrocarbyl group, such as a polyolefin-derived group. Typically the hydrocarbyl group is an alkyl or alkenyl group, such as a polyisobutenyl group. Alternatively expressed, the $R_3$ groups can contain about 40 to about 500 carbon atoms, and these atoms may be present in aliphatic forms. $R_4$ is an alkylene group, commonly an ethylene ($C_2H_4$) group; and z is 1 to 11. Examples of succinimide dispersants include those described in, for example, U.S. Pat. Nos. 3,172,892, 4,234,435 and 6,165,235.

Succinimide dispersants are referred to as such since they normally contain nitrogen largely in the form of imide functionality, although the nitrogen functionality may be in the form of amines, amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

In another preferred embodiment, the dispersant is a succinimide prepared by the reaction of a high molecular weight alkenyl- or alkyl-substituted succinic anhydride and a polyalkylene polyamine having 4 to 10 nitrogen atoms (average value), preferably 5 to 7 nitrogen atoms (average value) per mole.

The dispersant may be any suitable dispersant or mixture of multiple dispersants for use in a lubricating oil. In one embodiment, the dispersant is an ashless dispersant, such as an ashless dispersant that comprises an alkenyl- or alkyl-succinimide or a derivative thereof, such as a polyalkylene succinimide (preferably, polyisobutene succinimide). In a preferred embodiment, the dispersant is a succinimide or a derivative thereof. In another embodiment, the dispersant is a succinimide or derivative thereof which is obtained by reaction of a polybutenylsuccinic anhydride and a polyamine. In another embodiment, the dispersant is a succinimide or derivative thereof which is obtained by reaction of a polybutenylsuccinic anhydride and a polyamine, wherein the polybutenylsuccinic anhydride is produced from polybutene and maleic anhydride (such as by a thermal reaction method using neither chlorine or a chlorine atom-containing compound). In another preferred embodiment, the dispersant is a succinimide reaction product of the condensation reaction between polyisobutenyl succinic anhydride (PIBSA) and one or more alkylene polyamines. The PIBSA, in this embodiment, can be the thermal reaction product of high methylvinylidene polyisobutene (PIB) and maleic anhydride. In another preferred embodiment, the dispersant is primarily bis-succinimide reaction product derived from PIB having a number average molecular weight ($M_n$) of about 1400-3000, about 1400-2600, about 1400-2300, or even about 2000-3000. In another preferred embodiment, the dispersant is primarily bis-succinimide reaction product derived from PIB having a $M_n$ of at least about 1400, at least about 1500, at least about 1600, at least about 1700, at least about 1800, at least about 1900, at least about 2000, at least about 2100, at least about 2200, at least about 2300, at least about 2400, at least about 2500, at least about 2600, at least about 2700, at least about 2800, at least about 2900, at least about 3000.

In another preferred embodiment, the dispersant comprises an alkenyl- or alkyl-succinimide which is post-treated with a compound selected from a boric acid, an alcohol, an aldehyde, a ketone, an alkylphenol, a cyclic carbonate, an organic acid, a succinimide, a succinate ester, a succinate ester-amide, pentaerythritol, phenate-salicylate and their post-treated analogs or the like, or combinations or mixtures thereof. Preferable succinimides may be post-treated with a cyclic carbonate. Most preferably, the succinimide is post-treated with ethylene carbonate.

In another preferred embodiment, the dispersant is primarily a bis-succinimide reaction product derived from 2300 $M_n$ PIB which is subsequently reacted with ethylene carbonate. In another preferred embodiment, the dispersant is an ethylene carbonate post-treated bis-succinimide dispersant derived from polyisobutylene having a number average molecular weight (Mn) of 1400-3000. The post-treated succinimide dispersant is prepared according to the methods described in U.S. Pat. Nos. 5,334,321 and 5,356,552 which are herein incorporated by reference. In general, a polyamine moiety of a succinimide can be modified with cyclic carbonates, such as ethylene carbonate. One or more nitrogen of the polyamine moiety react with the cyclic carbonate to include substituents such as a hydrocarbyl oxycarbonyl, a hydroxyhydrocarbyl oxycarbonyl, or a hydroxyl poly(oxyalkylene) oxycarbonyl group.

In one embodiment, the preferable succinimide does not contain boron. In one embodiment, the preferable post-treated succinimide does not contain boron. In one embodiment, the lubricating oil composition does not contain a succinimide dispersant which contains boron.

Preferably, the concentration of the one or more dispersants within the lubricating oil composition on an actives basis is greater than about 1.2 wt. %, greater than about 1.5 wt. %, greater than about 1.8 wt. %, or even greater than about 2.0 wt. %. In other preferred embodiments, the concentration of the one or more dispersant additives within the lubricating oil composition on an actives basis is about 1.2 to 8.0 wt. %, about 1.2 to 6.0 wt. %, about 1.2 to 5.5 wt. %, about 1.2 to 5.0 wt. %, about 1.5 to 5.0 wt. %, about 1.5 to 3.0 wt. %, about 1.5 to 4.0 wt. %, or even about 1.5 to 2.5 wt. %.

The post-treated alkenyl- or alkyl-succinimide ashless dispersant can have a TBN on an actives basis, of less than 70 mg KOH/g. In one embodiment the alkenyl- or alkyl-succinimide dispersant has a TBN on an actives basis of less than 60 mg KOH/g. In one embodiment, the alkenyl- or alkyl-succinimide dispersant has a TBN on an actives basis of less than 50 mg KOH/g. In one embodiment, the alkenyl- or alkyl-succinimide dispersant has a TBN on an actives basis of less than 40 mg KOH/g. In one embodiment, the alkenyl- or alkyl-succinimide dispersant has a TBN on an actives basis of less than 30 mg KOH/g.

The lubricating oil composition can have any TBN that is suitable for use in trunk piston engines operated using low sulfur distillate fuel. For example, in some embodiments, the TBN of the lubricating oil composition is less than 30 mg KOH/g. In other embodiments, the TBN of the lubricating oil composition is from 5 to 25, from 6 to 20, from 8 to 18, 10 to 16, and 16 mg KOH/g.

The lubricating oil compositions can have any viscosity that is suitable for use in a trunk piston engine. In one embodiment, the lubricating oil composition has a viscosity of at least about 5, at least about 10, at least about 15, or at least about 20 cSt at 100° C. In another embodiment, the lubricating oil composition has a viscosity of about 5.6-21.9 cSt at 100° C., such as about 5.6-9.3 cSt at 100° C., about 9.3-16.3 cSt at 100° C., about 9.3-12.5 cSt at 100° C., about 12.5-16.3 cSt at 100° C., or about 16.3-21.9 cSt at 100° C. The viscosity of the lubricating oil composition can be measured in any suitable method, such as by ASTM D2270.

In one embodiment, the lubricating oil composition contains no detergent that does not contain a salt of an alkyl-substituted hydroxybenzoic acid.

In one embodiment, the lubricating oil composition does not contain an overbased detergent comprising a salt of an alkyl-substituted hydroxybenzoic acid having at least 50 mole % of alkyl groups that are $C_{14}$ to $C_{18}$.

In the present invention, the lubricating oil composition does not contain a salt of a sulfonic acid.

In the present invention, the detergent of the lubricating oil composition does not contain a sulfurized metal alkyl phenate.

The Oil of Lubricating Viscosity

The base oil of lubricating viscosity for use in the lubricating oil compositions of this invention is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered base oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil. Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any Group I or Group II lubricating base oil or mixtures thereof.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in API categories I and II, as defined in API Publication 1509, 14th Edition, Addendum I, December 1998 Group I and II base oils are preferred for use in this invention.

The saturates levels, sulfur levels and viscosity indices for Group I and II base oils are listed in Table 1 below.

TABLE 1

| Group | Saturates (As determined by ASTM D 2007) | Sulfur (As determined by ASTM D 2270) | Viscosity Index (As determined by ASTM D 4294, ASTM D 4297 or ASTM D 3120) |
|---|---|---|---|
| I | Less than 90% saturates. | Greater than or equal to 0.03% sulfur. | Greater than or equal to 80 and less than 120. |
| II | Greater than or equal to 90% saturates. | Less than or equal to 0.03% sulfur. | Greater than or equal to 80 and less than 120. |

In one embodiment, the base oil is a Group II base oil, or a blend of two or more different Group II base oils. In another embodiment, the base oil is a Group I base oil, or a blend of two or more different Group I base oils. In another embodiment, the base oil is a mixture of Group I and Group II base oils. Suitable Group I base oils include, for example, any light overhead cuts and heavier side cuts from a vacuum distillation column, such as, for example, any Light Neutral, Medium Neutral, and Heavy Neutral base stocks. The petroleum derived base oil also may include residual stocks or bottoms fractions, such as, for example, bright stock. Bright stock is a high viscosity base oil which has been conventionally produced from residual stocks or bottoms and has been highly refined and dewaxed. Bright stock can have a kinematic viscosity greater than about 180 cSt at 40° C., or even greater than about 250 cSt at 40° C., or even ranging from about 500 to about 1100 cSt at 40° C.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

Additional Lubricating Oil Additives

The lubricating oil compositions prepared by the process of the present invention may also contain other conventional additives for imparting auxiliary functions to give a finished lubricating oil composition in which these additives are dispersed or dissolved. For example, the lubricating oil compositions can be blended with antioxidants, anti-wear agents, ashless dispersants, detergents, rust inhibitors, dehazing agents, demulsifying agents, metal deactivating agents, friction modifiers, antifoaming agents, pour point depressants, co-solvents, package compatibilisers, corrosion-inhibitors, dyes, extreme pressure agents and the like and mixtures thereof. A variety of the additives are known and commercially available. These additives, or their analogous compounds, may be employed for the preparation of the lubricating oil compositions of the invention by the usual blending procedures.

Examples of antiwear agents include, but are not limited to, zinc dialkyldithiophosphates and zinc diaryldithiophosphates, e.g., those described in an article by Born et al. entitled "Relationship between Chemical Structure and Effectiveness of some Metallic Dialkyl- and Diaryl-dithiophosphates in Different Lubricated Mechanisms", appearing in Lubrication Science 4-2 Jan. 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are herein incorporated by reference; friction modifiers obtained from a reaction product of a $C_4$ to $C_{75}$, preferably a $C_6$ to $C_{24}$, and most preferably a $C_6$ to $C_{20}$ fatty acid ester and a nitrogen-containing compound selected from the group consisting of ammonia, and an alkanolamine and the like and mixtures thereof.

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

Examples of antioxidants include, but are not limited to, aminic types, such as diphenylamine, phenyl-alpha-napthylamine, N, N-di (alkylphenyl) amines, alkylated phenylenediamines, alkylated diphenylamines, and mixtures thereof. In one embodiment, the aminic antioxidant is alkylated diphenylamine. Examples of phenolic type antioxidants include, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, may range, unless otherwise specified, from about 0.001% to about 20% by weight, and in one embodiment about 0.01% to about 10% by weight based on the total weight of the lubricating oil composition.

In another embodiment of the invention, the composition prepared by the process of the present invention may be provided as an additive package or concentrate in which the additive is incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will also typically contain one or more of the various other additives, referred to above, in the desired amounts and ratios to facilitate direct combination with the requisite amount of base oil.

EXAMPLES

The following non-limiting examples are illustrative of the present invention.

The advantages of this invention were demonstrated by testing Group I and Group II based trunk piston engine oil compositions containing at least one overbased detergent comprising a salt of an alkyl-substituted hydroxybenzoic acid in combination with a succinimide dispersant.

Detergent A: An oil concentrate of an overbased calcium alkylhydroxybenzoate additive, having an alkyl substituent derived from $C_{20}$ to $C_{28}$ linear olefins, prepared according to the method described in Example 1 of US Patent Application 2007/0027043. This additive contained 5.35 wt. % Ca, and about 35.0 wt. % diluent oil (65% actives), and had a TBN of 150 mg KOH/g.

Detergent B: An oil concentrate of an overbased calcium alkylhydroxybenzoate additive, having an alkyl substituent derived from $C_{20}$ to $C_{28}$ linear olefins, prepared according to the method described in Example 1 of US Patent Application 2007/0027043. This additive contained 12.5 wt. % Ca, and about 33.0 wt. % diluent oil (67% actives), and had a TBN of 350 mg KOH/g.

Detergent C: An oil concentrate of an overbased calcium alkylhydroxybenzoate additive, having an alkyl substituent derived from $C_{14}$ to $C_{18}$ linear alpha olefins. This additive contained 9.87 wt. % Ca, and about 40.0 wt. % diluent oil (60% actives), and had a TBN of 280 mg KOH/g.

Detergent D: An oil concentrate of an overbased calcium alkylhydroxybenzoate additive, having an alkyl substituent derived from $C_{14}$ to $C_{18}$ linear alpha olefins. This additive contained 6.25 wt. % Ca, and about 41.0 wt. % diluent oil (59% actives), and had a TBN of 175 mg KOH/g.

Dispersant A: An oil concentrate of an ethylene carbonate post-treated primarily bis-succinimide dispersant derived from 2300 MW polyisobutylene and heavy polyamine. This additive contained 1.0% N, about 43% diluent oil (57% actives) and had a TBN of 12.5 mg KOH/g.

Dispersant B: An oil concentrate of a primarily bis-succinimide dispersant derived from 1000 MW polyisobutylene and heavy polyamine/DETA (80/20 wt/wt). This additive contained 2.0% N, about 32% diluent oil (68% actives) and had a TBN of 38 mg KOH/g.

Dispersant C: An oil concentrate of a borated post-treated primarily bis-succinimide dispersant derived from 1000 MW polyisobutylene and heavy polyamine. This additive contained 2.2% N, about 45% diluent oil (55% actives) and had a TBN of 52 mg KOH/g.

Dispersant D: An oil concentrate of a primarily bissuccinimide dispersant derived from 2300 MW polyisobutylene and heavy polyamine. This additive is the bissuccinimide precursor to Dispersant A before the post-treatment of ethylene carbonate. This additive contained 1.25% N, about 42% diluent oil (58% actives) and had a TBN of 29 mg KOH/g.

Dispersant E: An oil concentrate of an ethylene carbonate post-treated primarily bis-succinimide dispersant derived from 1000 MW polyisobutylene and heavy polyamine. This additive contained 2.3% N, about 33% diluent oil (67% actives) and had a TBN of 29 mg KOH/g.

Finished trunk piston engine lubricating oil compositions were obtained by mixing together the appropriate Group I basestocks, an overbased calcium alkylhydroxybenzoate detergent, dispersant, secondary zinc dialkyldithiophosphate, demulsifier, and foam inhibitor. The trunk piston engine oil compositions of Table 1 were formulated to a TBN of about 12 mg KOH/g and SAE 40 viscosity grade. The TPEOs of Table 1 were formulated to about equal detergent soap concentrations.

TABLE 1

SAE 40, 12 BN Trunk Piston Engine Lubricating Oil Compositions

| | Comp 1 | Ex. 1 | Ex 2 | Ex 3 | Ex4 | Comp 2 | Comp 3 | Comp 4 | Comp 5 | Comp 6 |
|---|---|---|---|---|---|---|---|---|---|---|
| Detergent A, wt. % | 2.82 | 2.48 | 2.48 | 2.54 | 2.72 | 2.37 | 2.33 | — | 3.11 | 2.65 |
| Detergent B, wt. % | 1.78 | 2.21 | 2.20 | 2.14 | 1.91 | 2.34 | 2.40 | — | 1.42 | 2.00 |
| Detergent C, wt. % | — | — | — | — | — | — | — | 2.76 | — | — |
| Detergent D, wt. % | — | — | — | — | — | — | — | 2.19 | — | — |
| Dispersant A, wt. % | — | 4.00 | 4.82 | 6.0 | — | 2.0 | 1.0 | 4.0 | — | — |
| Dispersant B, wt. % | 4.00 | — | — | — | — | — | — | — | — | — |
| Dispersant C, wt. % | — | — | — | — | — | — | — | — | 4.58 | — |
| Dispersant D, wt. % | — | — | — | — | 4.29 | — | — | — | — | — |
| Dispersant E, wt. % | — | — | — | — | — | — | — | — | — | 3.75 |
| XOMCore 600N wt. % | 89.69 | 85.61 | 81.08 | 74.53 | 81.93 | 88.16 | 83.74 | 87.42 | 90.06 | 88.32 |
| XOMCore 2500BS wt. % | 0.95 | — | — | — | — | 4.37 | 9.77 | — | 0.07 | 2.52 |
| XOMCore 150N wt. % | — | 4.94 | 8.66 | 14.03 | 8.39 | — | — | 2.87 | — | — |
| Vis (100° C.), $mm^2/s$ | 14.33 | 14.23 | 14.0 | 13.83 | 14.6 | 14.53 | 14.52 | 14.03 | 14.5 | 14.6 |

The Group I basestocks used were ExxonMobil CORE® 600 Group I base stock, ExxonMobil CORE® 150 Group I base stock or ExxonMobil CORE® 2500BS Group I bright stock or mixtures thereof.

Additional trunk piston engine lubricating oil compositions were obtained by mixing together a major amount of Group II basestock, an overbased calcium alkylhydroxybenzoate detergent, dispersant, secondary zinc dialkyldithiophosphate, demulsifier, and foam inhibitor. The trunk piston engine oil compositions of Table 2 were formulated to a TBN of about 12 mg KOH/g and SAE 40 viscosity grade. The TPEOs of Table 2 were formulated to about equal detergent soap concentrations.

TABLE 2

| | Ex. 5 | Ex. 6 | Ex. 7 | Comp 7 |
|---|---|---|---|---|
| Detergent A, wt. % | 2.48 | 2.54 | 2.37 | 2.33 |
| Detergent B, wt. % | 2.21 | 2.14 | 2.34 | 2.40 |
| Dispersant A, wt. % | 4.00 | 6.0 | 2.0 | 1.0 |
| Chevron RLOP 600 wt. % | 88.26 | 76.84 | 85.21 | 80.94 |
| XOM Core 2500BS wt. % | — | — | 7.32 | 12.57 |
| XOMCore 150N wt. % | 2.29 | 11.72 | — | — |

The Group II basestock used was Chevron RLOP 600R, available from Chevron Products Co. (San Ramon, Calif.). The Group I basestocks were ExxonMobil CORE® 150 Group I base stock, ExxonMobil CORE® 2500BS Group I bright stock or mixtures thereof.

The tests used for evaluation of the lubricating oil compositions were the Komatsu Hot Tube (KHT) test, which is a measure of high temperature detergency; the Modified Institute of Petroleum 48 ("MIP-48") test, which is a measure of the degree of stability against oxidation-based viscosity increase of the lubricant, and the Differential Scanning calorimeter (DSC) Test which is used to evaluate thin film oxidation stability of test oils. The measure of detergency and degree of stability against oxidation-based viscosity increase of the lubricant are key performance factors for trunk piston engine oils.

Modified Institute of Petroleum 48 Test

The MIP-48 Test measures the degree of stability against oxidation-based viscosity increase of the lubricant. The test consists of a thermal and an oxidative part. During both parts of the test the test samples are heated for a period of time. In the thermal part of the test, nitrogen is passed through a heated oil sample for 24 hours and in parallel during the oxidative part of the test, air is passed through a heated oil sample for 24 hours. The samples were cooled and the viscosities of both samples were determined. The viscosity increase of the test oil caused by oxidation are determined and corrected for the thermal effect. The oxidation-based viscosity increase for each marine trunk piston engine oil composition was calculated by subtracting the kinematic viscosity at 200° C. for the nitrogen-blown sample from the kinematic viscosity at 200° C. for the air-blown sample, and dividing the subtraction product by the kinematic viscosity at 200° C. for the nitrogen blown sample.

Komatsu Hot Tube (KHT) Test

The Komatsu Hot Tube test is a lubrication industry bench test that measures the degree of high temperature detergency and thermal and oxidative stability of a lubricating oil. During the test, a specified amount of test oil is pumped upwards through a glass tube that is placed inside an oven set at a certain temperature. Air is introduced in the oil stream before the oil enters the glass tube, and flows upward with the oil. Evaluations of the marine trunk piston engine lubricating oils were conducted at temperatures between 300-320° C. After cooling and washing, the test result is determined by comparing the amount of lacquer deposited on the glass test tube to a rating scale ranging from 1.0 (very black) to 10.0 (perfectly clean). The result is reported in multiples of 0.5. In the case the glass tubes are completely blocked with deposits, the test result is recorded as "blocked". Blockage is deposition below a 1.0 result, in which case the lacquer is very thick and dark but still allows fluid flow, although at a rate that is completely unsatisfactory for a usable oil. Suitable performance in the KHT test for the lubricating oil compositions of this invention is indicated by an overall rating of 5.5 or greater at 300° C.

Differential Scanning Calorimeter (DSC) Test

The DSC test is used to evaluate thin film oxidation stability of test oils, in accordance with ASTM D-6186. Heat flow to and from test oil in a sample cup is compared to a reference cup during the test. The Oxidation Onset Temperature is the temperature at which the oxidation of the test oil starts. The Oxidation Induction Time is the time at which the oxidation of the test oil starts. The oxidation reaction results in an exothermic reaction which is clearly shown by the heat flow. The Oxidation Induction Time is calculated to evaluate the thin film oxidation stability of the test oil. Oils which demonstrate improved thin film oxidation stability will result in higher oxidation induction times, relative to comparative test oils.

The MIP-48 Test, KHT Test and DSC oxidation tests were applied to the marine trunk piston engine lubricating oil compositions set forth in Tables 1 and 2. The results are set forth in Table 3 below.

TABLE 3

| Example | Dispersant | Basestock | Viscosity increase (%) | @ 300° C., rating | @ 310° C., rating | Oxidation Induction Time (min) |
|---|---|---|---|---|---|---|
| Comp. 1 | B | Group I | 25 | 6 | 4 | 25.56 |
| Comp. 2 | A | Group I | 25 | 4.5 | blocked | 25.8 |
| Comp. 3 | A | Group I | 22 | 4.5 | blocked | 25.46 |
| Comp. 4 | A | Group I | 60 | 3.0 | 0 | 24.4 |
| Comp. 5 | C | Group I | 42 | 3.5 | 1.5 | 28.8 |
| Comp. 6 | E | Group I | 25 | 4.5 | 2.5 | 25.5 |
| Ex. 1 | A | Group I | 19 | 7 | 3.5 | 26.8 |
| Ex. 2 | A | Group I | 23 | 5.5 | 2.5 | 25.95 |
| Ex. 3 | A | Group I | 18 | 5.5 | 2.5 | 26.6 |
| Ex. 4 | D | Group I | 17 | 5.5 | 2.5 | 25.7 |
| Ex. 5 | A | Group II | 0.1 | 6.5 | 1.5 | 24.89 |
| Ex. 6 | A | Group II | 3 | 5.5 | blocked | 25.67 |
| Ex. 7 | A | Group II | 7 | 5.5 | blocked | 24.27 |
| Comp. 7 | A | Group II | 26 | 5.5 | 2.5 | 23.92 |

As is evident from the results illustrated in Table 3, the trunk piston engine lubricating oil compositions comprising an overbased salt of an alkyl-substituted hydroxybenzoic acid having at least 90 mole % $C_{20}$ or greater alkyl groups, in combination with greater than 1.2 wt. % (on an actives basis) bis-succinimide dispersant derived from a polyisobutylene group of 2300 number average molecular weight (Dispersants A and D) exhibited both surprisingly better stability against oxidation-based viscosity increase (<25% viscosity increase) and a rating of 5.5 or greater at 300° C. in the KHT test in comparison to the reference oil (Comparative Example 1) and the lubricating oil compositions which contained an overbased salt of an alkyl-substituted hydroxybenzoic acid in combination with either a post-treated or a non post-treated bis-succinimide dispersant derived from a polyisobutylene group having a number average molecular weight ($M_e$) of 1000 (Dispersants B, C and E). The lubricating oil compositions of this invention exhibited either comparable or directionally improved thin film oxidation stability performance as is evident by the DSC oxidation test results.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification is to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "of" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A low sulfur marine distillate fuel trunk piston diesel engine lubricating oil composition comprising:

(a) a major amount of a Group I base oil or a Group II base oil or mixtures thereof;

(b) at least one or more detergents comprising at least one overbased salt of an alkyl-substituted hydroxybenzoic acid; and (c) a succinimide dispersant derived from polyalkylene having a number average molecular weight (Mn) of 1400-3000;

wherein the alkyl groups of the overbased salt of an alkyl-substituted hydroxybenzoic acid, are at least 90 mole % C20 or greater; and wherein the succinimide dispersant is present at greater than 1.2 wt. % on an actives basis; and the TBN of the low sulfur marine distillate fuel trunk piston diesel engine lubrication oil composition is less than 30 mg KOH/g.

2. The lubricating oil composition of claim 1, wherein the low sulfur marine distillate fuel comprises less than 0.1 wt. % sulfur relative to total weight of the low sulfur marine distillate fuel.

3. The lubricating oil composition of any of the preceding claims, wherein the base oil comprises a major amount of Group I base oil.

4. The lubricating oil composition of claim 1 or 2, wherein the base oil comprises a major amount of Group II base oil.

5. The lubricating oil composition of claim 1, wherein the alkyl groups of the overbased salt of an alkyl-substituted hydroxybenzoic acid, are at least 90 mole % C20 or greater.

6. The lubricating oil composition of claim 1, wherein the alkyl groups of the overbased salt of an alkyl-substituted hydroxybenzoic acid, are C20 to C28.

7. The lubricating oil composition of claim 1, wherein the TBN of the overbased salt of an alkyl-substituted hydroxybenzoic acid, is greater than 150 mg KOH/g on an actives basis.

8. The lubricating oil composition of claim 1, wherein the at least one or more detergents comprising at least one overbased salt of an alkyl-substituted hydroxybenzoic acid is a detergent composition comprising (i) a medium overbased detergent comprising an overbased salt of an alkyl-substituted hydroxybenzoic acid; and (ii) a high overbased detergent comprising an overbased salt of an alkyl-substituted hydroxybenzoic acid.

9. The lubricating oil composition of claim 1, wherein the TBN of the low sulfur marine distillate fuel trunk piston diesel engine lubricating oil composition is from 5 to 25 mg KOH/g.

10. The lubricating oil composition of claim 1, wherein the succinimide dispersant is an ethylene carbonate post-treated bis-succinimide dispersant.

11. A low sulfur marine distillate fuel trunk piston diesel engine lubricating oil composition comprising:

(a) a major amount of a Group I base oil;

(b) a detergent composition comprising:

(i) a medium overbased detergent comprising an overbased salt of a linear alkyl-substituted hydroxybenzoic acid, wherein at least 90 mole % of the alkyl groups are C20 or greater, and wherein the TBN of the medium overbased detergent on an actives basis is from about 100 to 300 mg KOH/g; and (ii) a high overbased detergent comprising an overbased salt of a linear alkyl-substituted hydroxybenzoic acid, wherein at least 90 mole % of the alkyl groups are C20 or greater, and wherein the TBN of the high overbased detergent on an actives basis is greater than about 300 mg KOH/g; and (c) an ethylene carbonate post-treated bis-succinimide dispersant derived from polyisobutylene having a number average molecular weight (Mn) of 1400-3000; wherein the succinimide dispersant is present at greater than 1.20 wt. % on an actives basis; and the TBN of the composition is less than 30 mg KOH/g.

12. A method for operating a trunk piston engine comprising:

(a) fueling the engine with a low sulfur marine distillate fuel, and (b) lubricating the engine with a lubricating oil composition comprising (i) a major amount of a Group base oil or a Group II base oil or mixtures thereof; (ii) at least one or more detergents comprising at least one overbased salt of an alkyl substituted hydroxybenzoic acid; and (iii) a succinimide dispersant derived from polyalkylene having a number average molecular weight (Mn) of 1400-3000; wherein the succinimide dispersant is present at greater than 1.20 wt % on an actives basis; and the TBN of the composition is less than 30 mg KOH/g.

13. The method of claim 12, wherein the base oil comprises a major amount of Group II base oil.

14. The method of claim 12, wherein the alkyl groups of the overbased salt of an alkyl-substituted hydroxybenzoic acid, are at least 90 mole % C20 or greater.

15. The method of claim 12, wherein the alkyl groups of the overbased salt of an alkyl-substituted hydroxybenzoic acid, are C20 to C28.

16. The method of claim 12, wherein the TBN of the overbased salt of an alkyl-substituted hydroxybenzoic add, is greater than 150 mg KOH/g on an actives basis.

17. The method of claim 12, wherein the detergent comprising at least one overbased salt of an alkyl-substituted hydroxybenzoic add is a detergent composition comprising (i) a medium overbased detergent comprising an overbased salt of an alkyl-substituted hydroxybenzoic acid; and (ii) a high overbased detergent comprising an overbased salt of an alkyl-substituted hydroxybenzoic add.

18. The method of claim 12, wherein the TBN of the low sulfur marine distillate fuel trunk piston diesel engine lubricating oil composition is from 5 to 25 mg KOH/g.

19. The method of claim 12, wherein the succinimide dispersant is primarily a bis-succinimide dispersant.

20. The method of claim 12, wherein the succinimide, dispersant is an ethylene carbonate post-treated succinimide dispersant.

* * * * *